United States Patent [19]

Blaese

[11] Patent Number: 5,017,934

[45] **Date of Patent: * May 21, 1991**

[54] PORTABLE ANTENNA

[76] Inventor: Herbert R. Blaese, 3314 Olcott Ave., Chicago, Ill. 60634

[ * ] Notice: The portion of the term of this patent subsequent to Jul. 3, 2007 has been disclaimed.

[21] Appl. No.: 383,323

[22] Filed: Jul. 21, 1989

Related U.S. Application Data

[62] Division of Ser. No. 230,424, Aug. 10, 1988, Pat. No. 4,939,524, which is a division of Ser. No. 164,246, Mar. 4, 1988, Pat. No. 4,804,969.

[51] Int. Cl.[5] ..... H01Q 1/32

[52] U.S. Cl. ..... 343/713; 343/715; 343/888

[58] Field of Search ..... 343/715, 711, 880, 888, 343/892, 713

[56] References Cited

U.S. PATENT DOCUMENTS

| | | | |
|---|---|---|---|
| 4,238,799 | 12/1980 | Parfitt | 343/749 |
| 4,658,259 | 4/1987 | Blaese | 343/715 |
| 4,692,770 | 9/1987 | Kadokura | 343/715 |
| 4,779,098 | 10/1988 | Blaese | 343/715 |
| 4,794,319 | 12/1988 | Shimazaki | 343/715 |
| 4,804,969 | 2/1989 | Blaese | 343/715 |
| 4,825,217 | 4/1989 | Choi | 343/715 |
| 4,839,660 | 6/1989 | Hadzoglou | 343/715 |

FOREIGN PATENT DOCUMENTS

| | | | |
|---|---|---|---|
| 1203227 | 1/1960 | France | 343/715 |
| 1227757 | 8/1960 | France | 343/715 |

*Primary Examiner*—Rolf Hille
*Assistant Examiner*—Hoanganh Le
*Attorney, Agent, or Firm*—Gerstman & Ellis, Ltd.

[57] ABSTRACT

A portable antenna is provided for mounting on a motor vehicle's side window and enabling easy and rapid mounting and removal. The portable antenna includes an outer RF transfer member, a current-fed radiator connected to the outer RF transfer member, an inner RF transfer member, a field-cancelling member operative to cancel the electromagnetic field in the plane of the field-cancelling member, and a pair of generally parallel wire members pivotally connecting the outer transfer member to the inner transfer member and bridging the inner and outer transfer members so as to overlie the side window when the antenna is mounted thereon.

1 Claim, 2 Drawing Sheets

FIG. 4
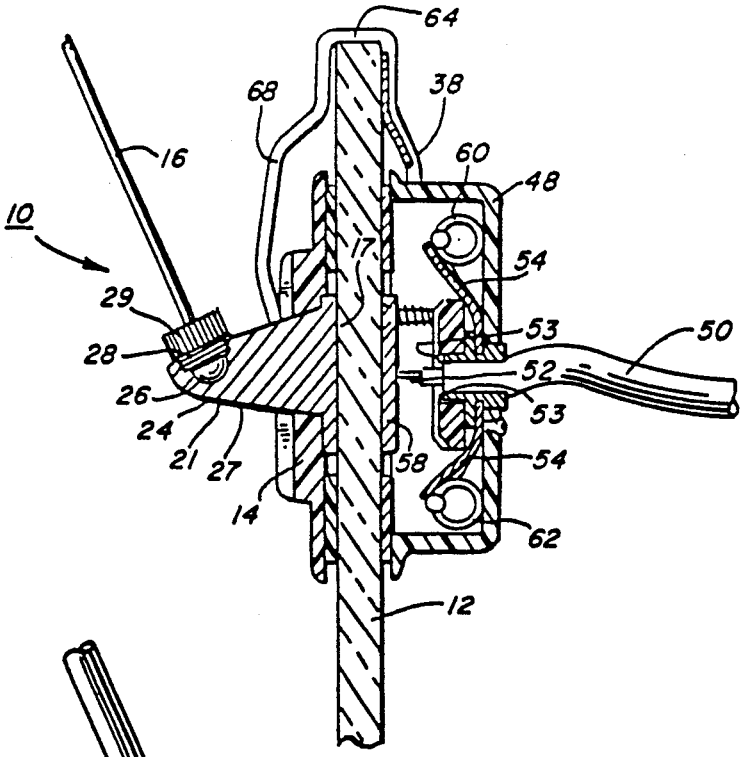
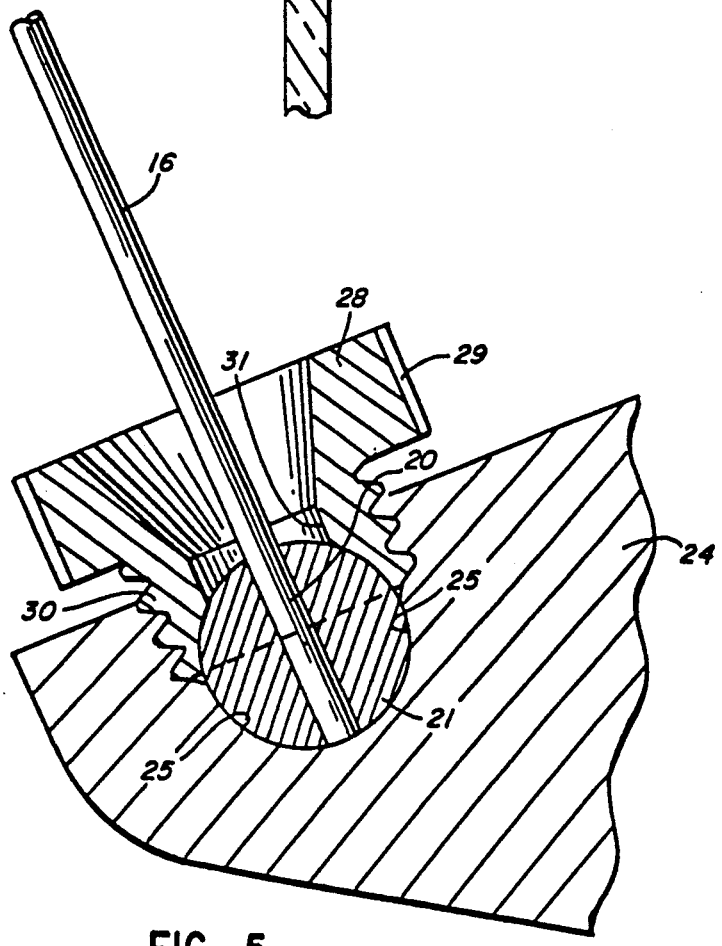
FIG. 5

PORTABLE ANTENNA

This is a division of application Ser. No. 230,424, filed Aug. 10, 1988, U.S. Pat. No. 4,939,524 which in turn, is a division of U.S. Ser. No. 164,246, filed 3/4/88 U.S. Pat. No. 4,804,969.

FIELD OF THE INVENTION

The present invention concerns a novel antenna, and more particularly, a portable antenna for mounting on the side window of a motor vehicle.

BACKGROUND OF THE INVENTION

In U.S. Pat. No. 4,658,259, a current-fed antenna is disclosed for mounting on a glass plate with a radiator extending from one side of the glass plate and with the electrical wire extending from the opposite side of the glass plate whereby energy is transferred through the glass plate and the drilling of a hole for coupling the radiator to the electrical wiring is unnecessary. On occasion it is desirable to have an antenna, useful with a cellular telephone in a motor vehicle, that is portable so that it may be easily and rapidly mounted and dismounted from the window of the vehicle.

Certain prior art portable antennas have been found to have various undesirable qualities. For example, one prior art portable antenna used with motor vehicles requires the electrical cable to be extended from the inside of the vehicle to the outside of the window to which the antenna is connected. Another prior art motor vehicle antenna is voltage-fed which often creates problems when contaminants such as dirt and salt are introduced on the window surface and mixed with rain and snow, degrading the performance of the antenna. In addition, a voltage-fed antenna requires an LC resonant circuit which inherently has some loss, and the loss increases as the circuit becomes detuned.

It is, therefore, an object of the present invention to provide an antenna that is portable and alleviates many of the problems concomitant with prior art antennas.

Another object of the present invention is to provide an antenna that is simple in construction and efficient to manufacture.

Other objects and advantages of the present invention will become apparent as the description proceeds.

SUMMARY OF THE INVENTION

In accordance with the present invention, a portable antenna is provided for mounting on a motor vehicle's side window which enables easy and rapid mounting and removal. The portable antenna includes an outer RF transfer member comprising a weather-resistant carrier having a first electrically conductive member on its underside for engagement with the outside of the side window. A current-fed radiator is provided for location on the outside of the side window and is connected to the first electrically conductive member. An inner RF transfer member is provided including a housing and having a second electrically conductive member on its underside for engagement with the inside of the side window.

An electrical cable is provided having a main electrical conductor and a ground conductor. The main electrical conductor is in electrical engagement with the second electrically conductive member, and the electrical cable is located only on the inside of the side window in the illustrative embodiment.

The housing carries a field-cancelling member operative to cancel the electromagnetic field in the plane of the field-cancelling member. The field-cancelling member is in electrical engagement with the ground conductor.

Means are provided for pivotally connecting the outer RF transfer member to the inner RF transfer member. The pivotally connecting means bridges the inner RF transfer member and the outer transfer member so as to overlie the side window when the antenna is mounted thereon.

In the illustrative embodiment, a metal radiator mounting member is connected to the weather-resistant carrier. The radiator has an enlarged proximal end received within the radiator mounting member. A threaded member is provided for cooperating with the enlarged end for enabling directional adjustment of the radiator.

In the illustrative embodiment, the field-cancelling member comprises a pair of electrically conductive rods, the ends of which extend in opposite directions with respect housing. Each rod is about one-half wavelength in electrical length. In order to physically shorten the electrically conductive rod, the central portion thereof is coiled.

In the illustrative embodiment, the weather-resistant carrier includes a pair of opposed journal members for receiving the pivotally connecting means. The pivotally connecting means comprises a pair of generally parallel wire members each of which has an end portion journaled within one of the journal members and an opposite end portion connected to the inner transfer member.

A more detailed explanation of the invention is provided in the following description and claims, and is illustrated in the accompanying drawings.

BRIEF DESCRIPTION OF THE DRAWINGS

FIG. 4 is a cross-sectional elevation thereof, taken along the plane of the line 4—4 of FIG. 1; and FIG. 5 is an enlarged cross-sectional view of the radiator mounting portion of the antenna.

DETAILED DESCRIPTION OF THE ILLUSTRATIVE EMBODIMENT

Figure 1:
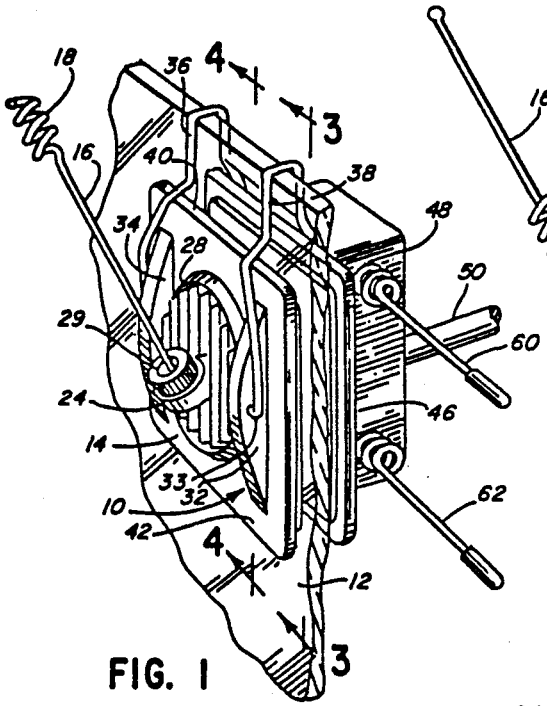
FIG. 1 is a perspective view of an antenna constructed in accordance with the principles of the present invention.
Figure 2:
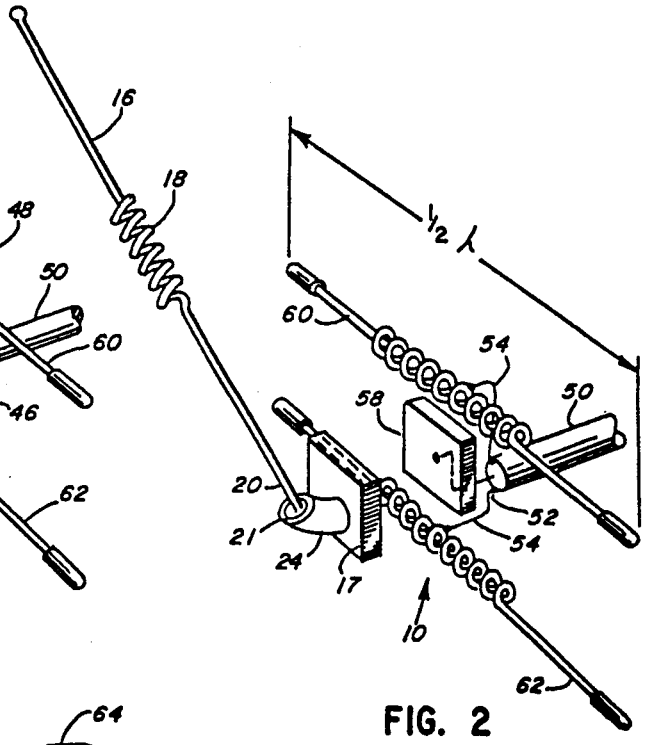
FIG. 2 is a diagrammatic view thereof.
Figure 3:
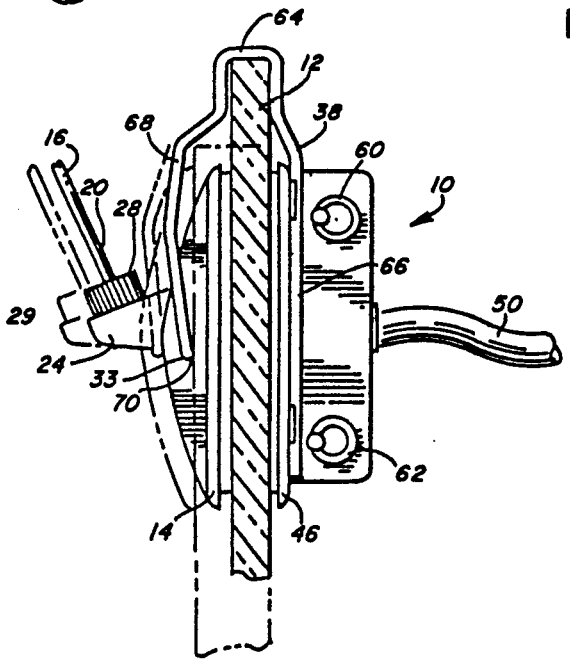
FIG. 3 is a cross-sectional elevation thereof, taken along the plane of the line 3—3 of FIG. 1.

The antenna of the present invention utilizes the principles of the on-glass current-fed antenna disclosed in U.S. Pat. No. 4,658,259. Referring to the Figures herein, the portable antenna 10 of the present invention is adapted for mounting on the side window 12 of a motor vehicle. Antenna 10 comprises an outer RF transfer member 14 which includes a weather-resistant carrier formed of a suitable plastic material having an electrically conductive plate 17 on its underside. In this manner, when outer RF transfer member 14 is positioned on the window 12 as illustrated in FIGS. 1 and 3, electrically conductive plate 17 will be in engagement with the outside of window 12.

Antenna 10 includes a current-fed radiator 16. In this embodiment, radiator 16 is a $\frac{5}{8}$ wavelength element stacked on a $\frac{3}{8}$ wavelength element with a phasing coil 18 separating the two elements to achieve gain. The proximal end 20 of radiator 16 comprises a mounting sphere 21 (FIG. 5) which is received within an internally threaded opening 25 defined by a metal radiator mounting member 24 that is connected to the weather-resistant carrier and extends from electrically conductive plate 17.

Mounting sphere 21 on proximal end 20 of radiator 16 is pivotable within an externally threaded metal nut member 28. Nut member 28 comprises a knurled ring 29 with a downward externally threaded portion 30 which threadedly engages the internally threaded mounting member 24.

In order to connect radiator 16 to mounting member 24, nut 28 is screwed into member 24 by turning knurled ring 29 clockwise, driving mounting sphere 21 into the bottom of opening 25. Before sphere 21 reaches the bottom of opening 25, radiator 16 and its associated sphere may be pivoted to move within central opening 31 defined by nut 28. Thus radiator 16 can be pivoted to a desired position. Once it is pivoted to a desired position, knurled ring 29 is continued to be turned clockwise to drive sphere 21 tightly into opening 25, effectively locking sphere 21 and radiator 16 in place and providing a good electrical contact between electrically conductive sphere 21 and member 24 with plate 17.

The weather-resistant carrier 14 includes a pair of opposed journal members 32, 34, each of which defines a hole 33 for receiving a wire member. A pair of parallel wire members 36, 38 are provided with an end of each of the wire members extending into one of the holes 33, for enabling outer transfer member 14 to pivot about the axis of holes 33, which have a common axis. Openings 33 are located at the approximate midpoint between top end 40 of the outer transfer member 14 and bottom end 42 so as to enable the outer transfer member to pivot in a manner that is desirable for mounting.

Antenna 10 also comprises an inner RF transfer member 46 which includes a housing 48 and is preferably formed of a suitable plastic material. Inner transfer member 46 carries a second electrically conductive plate 58 on its underside. When the inner transfer member engages the inside of window 12, second electrically conductive plate 58 will be in engagement with the inside of window 12.

Antenna 10 is constructed so that electrical cable only need be provided on the inside of the motor vehicle. To this end, a conventional 50 ohm RF coaxial cable 50 having a central main conductor 52 and a concentric surrounding ground conductor 53 is connected to the inner transfer member.

A conventional connector (not shown) is provided at the distal end of cable 50 for connection to the cellular telephone transceiver.

The central main conductor 52 is electrically connected to second electrically conductive plate 58. The ground conductor 53 is connected via electrically conductive wires 54 to field-cancelling members 60, 62. Field-cancelling members 60, 62 comprise electrically conductive rods which are mounted within housing 48 and extend, when mounted, in a direction parallel to window 12 with the opposed ends of each of the field-cancelling members extending away from the housing 48 as illustrated. It is preferred that field-cancelling members 60, 62 be parallel to each other and be approximately one-half wavelength in electrical length, with the field-cancelling members being operative to cancel the electromagnetic field in the plane of the field-cancelling members.

In order to reduce the physical length of the field-cancelling members 60, 62, the central portion of each member is coiled, as illustrated. The field-cancelling members are flexible and have rubber tips at their ends for safety purposes.

It can be seen that outer transfer member 14 is pivotally connected to inner transfer member 46 by means of wire members 36 and 38. Each of the wire members is identical to the other wire member and has a U-shaped portion 64, which overlies the top of window 12, with a rear portion 66 that extends downwardly and is fastened to inner transfer member 46, and with a front portion 68 that extends outwardly and downwardly to provide an inwardly spaced end portion 70 that is received within one of openings 33 of one of the opposed journal members 32, 34. In this manner, end portion 70 is journaled within opening 33 so that the outer transfer member 14 can be pivoted when it is being mounted on window 12 to provide easy and rapid mounting thereon. The wire members 36 and 38 are formed of spring steel and have a resiliency so as to urge the inner member 46 and outer member 14 toward each other, to provide an effective engagement of first electrical plate 16 against the outside of window 12 and second electrical plate 58 against the inside of window 12. In this manner, RF energy is transferred through the window 12, the drilling of a hole for coupling the radiator coaxial cable 50 is unnecessary, and coaxial cable 50 can be positioned only within the inside of a vehicle, and it needs not be positioned on the outside thereof.

Although an illustrative embodiment of the invention has been shown and described, it is be understood that various modifications and substitutions may be made by those skilled in the art without departing from the novel spirit and scope of the present invention.

What is claimed is:

1. A portable RF antenna for mounting on a motor vehicle's side window and enabling easy and rapid mounting and removal, which comprises:

an outer RF transfer member comprising a weather-resistant carrier having a first electrically conductive member on its underside for engagement with the outside of the side window;

a radiator for location on the outside of the side window and connected to said first electrically conductive member;

an inner RF transfer member including a housing and having a second electrically conductive member on its underside for engagement with the inside of the side window;

said inner transfer member and said outer transfer member being adapted for alignment so that RF energy is transferred through the side window;

means for connecting said outer transfer member with respect to said inner transfer member, said connecting means bridging said inner transfer member and said outer transfer member so as to overlie the side window when the antenna is mounted thereon;

said connecting means being located so as not to provide a conductive connection between said first and second electrically conductive members;

an electrical antenna wire;

means coupling said electrical antenna wire to said second electrically conductive member with the antenna wire being located only on the inside of the side window and not on the outside of the side window.

* * * * *